US011890518B2

(12) United States Patent
Lindemann, II

(10) Patent No.: US 11,890,518 B2
(45) Date of Patent: Feb. 6, 2024

(54) BAT HANDLE WEIGHT

(71) Applicant: RITEND BAT WEIGHT LLC, Davie, FL (US)

(72) Inventor: Harold Edward Lindemann, II, Davie, FL (US)

(73) Assignee: Ritend Bat Weight LLC, Davie, FL (US)

( * ) Notice: Subject to any disclaimer, the term of this patent is extended or adjusted under 35 U.S.C. 154(b) by 0 days.

(21) Appl. No.: 16/429,458

(22) Filed: Jun. 3, 2019

(65) Prior Publication Data

US 2019/0366173 A1 Dec. 5, 2019

Related U.S. Application Data

(60) Provisional application No. 62/679,341, filed on Jun. 1, 2018.

(51) Int. Cl.

| | |
|---|---|
| ***A63B 60/24*** | (2015.01) |
| ***A63B 59/50*** | (2015.01) |
| ***A63B 69/00*** | (2006.01) |
| ***A63B 102/18*** | (2015.01) |

(52) U.S. Cl.

CPC ..... *A63B 60/24* (2015.10); *A63B 59/50* (2015.10); *A63B 2069/0008* (2013.01); *A63B 2102/18* (2015.10); *A63B 2209/00* (2013.01)

(58) Field of Classification Search

CPC ..... A63B 69/0002; A63B 2069/0008; A63B 2102/18; A63B 59/50; A63B 60/24

See application file for complete search history.

(56) References Cited

U.S. PATENT DOCUMENTS 1,696,462 A * 12/1928 Victor ..... A63B 60/24 473/297
2,608,409 A * 8/1952 Pinkerton ..... A63B 69/3638 473/256
3,136,546 A * 6/1964 Connolly ..... A63B 24/0062 473/234
3,161,930 A * 12/1964 Crosson ..... F16G 11/10 403/3
3,458,203 A * 7/1969 Mangis ..... A63B 69/3638 473/256
3,680,870 A * 8/1972 Burnett ..... A63B 69/3638 473/256

(Continued)

*Primary Examiner* — Melba Bumgarner
*Assistant Examiner* — Amir A Klayman
(74) *Attorney, Agent, or Firm* — The Concept Law Group, PA; Scott D. Smiley; Scott M. Garrett

(57) ABSTRACT

A bat handle weight includes a body having a transverse hole with a bat end opening sized to allow a bat handle end to be inserted into the transverse hole. The transverse hole tapers inward at an opposite end from the bat end opening to be narrower than the bat handle end, but wider than the bat handle. The bat handle weight is placed on the bat by placing the bat handle end into the bat end opening, and then rotating the body of the bat handle weight relative to the bat, where the inward tapered portion of the transverse hole bears against the top of the bat handle end, and the user's hand will bear against the outside of the bat handle weight when grasping the bat by the handle, thereby securing the bat handle weight on the bat so that the bat can be swung without the bat handle weight coming off the bat.

11 Claims, 15 Drawing Sheets

(56) References Cited

U.S. PATENT DOCUMENTS 3,716,239 A * 2/1973 Goudreau ..... A63B 69/3638 473/256
3,772,741 A * 11/1973 Rosalik ..... A41F 1/00 24/299
3,863,373 A * 2/1975 Kaercher ..... G09F 3/04 40/306
3,863,933 A * 2/1975 Tredway ..... A63B 69/3632 473/220
4,027,886 A * 6/1977 Katsube ..... A63B 69/3632 273/456
4,167,268 A * 9/1979 Lorang ..... A63B 69/3685 473/238
4,200,285 A * 4/1980 Petitti, Jr. ..... A63B 60/02 473/437
4,213,614 A * 7/1980 Philippi ..... A63B 21/0603 150/160
4,809,975 A * 3/1989 Lee ..... A63B 15/005 473/256
4,934,706 A * 6/1990 Marshall ..... A63B 69/3632 33/383
5,042,811 A * 8/1991 D'Amico ..... A63B 60/10 434/252
5,377,984 A * 1/1995 Ciccia ..... A63B 60/10 473/206
5,415,406 A * 5/1995 Reichenbach ..... A63B 21/0088 473/228
5,431,391 A * 7/1995 Tracey ..... A63B 69/3685 33/379
5,501,450 A * 3/1996 Nolan ..... A63B 15/00 473/256
6,145,664 A * 11/2000 Cope ..... B65D 21/062 206/506
6,152,831 A * 11/2000 Arcenas ..... A63B 53/14 473/409
6,250,338 B1 * 6/2001 Dempsey ..... E03C 1/04 4/678
6,540,621 B1 * 4/2003 Robinson ..... A63B 53/14 473/201
6,599,201 B1 * 7/2003 Grant ..... A63B 69/3638 473/226
6,955,610 B1 * 10/2005 Czaja ..... A63B 15/005 473/256
7,059,970 B1 * 6/2006 Hamburger ..... A63B 69/3685 473/226
7,063,625 B2 * 6/2006 Murtha ..... A63B 69/3685 473/251
7,124,477 B2 * 10/2006 Boland ..... A44B 15/00 24/116 A
7,201,683 B2 * 4/2007 Estape ..... A63B 60/10 473/568
7,261,639 B2 * 8/2007 Smith ..... A63B 57/00 473/409
7,309,292 B2 * 12/2007 Tu Teng ..... A63B 69/3614 473/256
7,540,813 B2 * 6/2009 Liberatore ..... A63B 15/00 473/457
7,686,711 B2 * 3/2010 Miller ..... A63B 69/0002 473/422
7,775,899 B1 * 8/2010 Cannon ..... A63B 69/3632 473/226
8,105,178 B2 * 1/2012 Sander ..... A63B 60/00 473/288
8,444,500 B2 * 5/2013 Erkkinen ..... A63B 69/3638 473/226
8,602,925 B1 * 12/2013 Rickon, Jr. ..... A63B 60/14 473/568
8,932,158 B2 * 1/2015 Caligure ..... A63B 60/08 473/568
9,234,336 B2 * 1/2016 Yang ..... E03C 1/0404
9,457,248 B2 * 10/2016 Long ..... A63B 71/141
9,468,823 B2 * 10/2016 Mitton ..... A63B 60/16
9,550,100 B2 * 1/2017 Grady, Jr. ..... A63B 60/06
9,702,110 B1 * 7/2017 Hilfiker ..... E02D 29/02
9,950,234 B2 * 4/2018 Park ..... A63B 69/3623
D871,530 S * 12/2019 Hamilton ..... D21/753
2003/0027656 A1 * 2/2003 Katsuya ..... A63B 21/0602 473/226
2004/0216789 A1 * 11/2004 Benstead ..... E03C 1/04 137/801
2004/0224804 A1 * 11/2004 Estape ..... A63B 60/08 473/568
2005/0095949 A1 * 5/2005 Fernandez, Jr. ..... A63H 3/003 446/236
2005/0245324 A1 * 11/2005 Light ..... A63B 69/3638 473/256
2005/0266928 A1 * 12/2005 Jacobs ..... A63B 53/14 473/226
2006/0270487 A1 * 11/2006 Tu Teng ..... A63B 69/3638 473/256
2008/0146384 A1 * 6/2008 Hansen ..... A63B 60/54 473/437
2009/0131191 A1 * 5/2009 Priester ..... A63B 69/3632 473/228
2010/0099508 A1 * 4/2010 Wolf ..... A63B 63/00 473/195
2011/0174945 A1 * 7/2011 Wood ..... A63B 71/0045 248/225.11
2011/0275458 A1 * 11/2011 Estrada, Jr. ..... A63B 21/0601 473/437
2012/0042972 A1 * 2/2012 Liu ..... E03C 1/04 137/801
2012/0285841 A1 * 11/2012 Noonan ..... A45D 27/225 206/204
2013/0053162 A1 * 2/2013 Marrero ..... A63B 69/3638 473/256
2015/0034776 A1 * 2/2015 St.John ..... F16L 3/02 248/68.1
2017/0007897 A1 * 1/2017 Schwanke ..... A63B 59/50
2017/0189779 A1 * 7/2017 Maclellan ..... A63B 15/00
2017/0234706 A1 * 8/2017 Martin ..... A63B 60/16 29/407.05
2018/0015340 A1 * 1/2018 Codd ..... A63B 60/24
2022/0047931 A1 * 2/2022 Cameron ..... A63B 69/3614

* cited by examiner

BAT HANDLE WEIGHT

CROSS-REFERENCE TO RELATED APPLICATION

This application is non-provisional conversion of U.S. provisional application No. 62/679,341, filed Jun. 1, 2018 and titled "Bat handle weight," the entirety of which is hereby incorporated by reference.

FIELD OF THE INVENTION

The present disclosure relates generally to sports equipment, and more particularly to bat weights which can be easily put on, and removed from a bat or similar sporting equipment.

BACKGROUND OF THE INVENTION

Bat weights have long been used in baseball to add weight to a bat to allow a batter to warm up prior to a turn at bat. Players commonly swing a weighted bat to warm up before a turn at bat, or for exercise. A typical bat weight is a donut or ring-shaped weight with a central hole through which the bat handle end is inserted, and the weight is moved up the bat towards the opposite end where it is stopped eventually by the larger diameter of the barrel of the bat interfering with the inner wall of the bat weight (i.e. the hole).

Although this has long been a conventional piece of equipment in baseball, placing the weight towards the far end of the bat, away from the player's hands, causes some issues. For one, the weight tends changes the moment of inertia of the bat substantially, and pulls the bat away from the player's body more when the bat/weight combination is swung because of the increased outward force created by the added weight. This is called casting, and it changes the player's swing, and muscle memory response. Since this is performed typically right before a turn at bat, it can have a detrimental effect on muscle memory and placing the bat swing where the batter intends to swing the bat.

Accordingly, there is a need for a way to add weight to a bat while minimizing the effect of casting.

SUMMARY OF THE INVENTION

The invention provides a bat handle weight that overcomes the hereinafore-mentioned disadvantages of the heretofore-known devices and methods of this general type and that couples to the handle end of a baseball bat, adjacent the batter's hands when gripping the bat handle, instead of positioning a weight on the barrel of the bat, away from the batter's hands. The result is that the bat with the additional weight of the bat handle weight provides the desired resistance without the casting effect of ring weights. By placing the weight on the handle, the moment of inertia of the bat is substantially different than a bat having a weight on the barrel of the bat. As a result, the inventive bat handle weight allows batter to warm up properly for a turn at-bat, without the disruptive effect on body mechanics and body muscle memory that results from casting effect caused by ring weights that fit on the barrel of the bat.

Some embodiments of the inventive disclosure provide a bat handle weight for attaching to a handle end of a bat. The handle end has a knob that has a larger diameter than a handle of the bat. The bat handle weight includes a body, and a transverse hole formed partway through the body that further forms a knob insertion opening at a side of the body.

The transverse hole has a diameter that is larger than the knob of the bat. The bat handle weight can further include a handle slot formed in the body that extends into the body to the transverse hole from the side at which the knob insertion opening is formed to an opposite side of the body, and from the knob insertion opening to an end of the transverse hole opposite the knob insertion opening centered along the transverse hole, and having a width that is less than the diameter of the transverse hole and greater than a diameter of the handle.

In accordance with another feature, the transverse hole forms a shoulder at a ninety degree angle to an inner wall defining the transverse hole.

In accordance with another feature, the transverse hole reduces in diameter towards the opposite side of the body to a diameter equal to the width of the handle slot.

In accordance with another feature, the body is cylindrical, and the transverse hole is formed in the body perpendicular to an axis of the body.

In accordance with another feature, the body is spherical.

In accordance with another feature, the body is semi-spherical.

In accordance with another feature, the bat handle weight further includes a covering over the body.

In accordance with another feature, the covering is comprised of vinyl.

In accordance with another feature, the body is metal.

Some embodiments of the inventive disclosure provide a bat handle weight for coupling to a handle of a baseball bat, the baseball bat having a knob formed at an end of the handle, the bat handle weight includes a body, and a transverse hole formed in the body thereby creating a knob insertion opening at a first side portion of the body, the transverse hole extending into the body towards a second side portion of the body that is opposite the first side portion. The transverse hole being sized to receive therein the knob of the baseball bat. The bat handle weight further includes a handle slot formed in the body from the first side portion to the second side portion and through a third side portion that is adjacent the first and second side portions. The handle slot extends to the transverse hole and across a bottom of the transverse hole at the second side portion. The handle slot and the transverse hole form a shoulder portion at a bottom of the transverse hole adjacent the second side portion. The handle slot has a width that that is greater than a diameter of the handle of the baseball bat and less than a diameter of the knob.

Some embodiments of the inventive disclosure provide a method for coupling a bat handle weight to a baseball bat that includes providing the bat handle weight that has a body and a transverse hole formed in the body thereby creating a knob insertion opening at a first side portion of the body. The transverse hole extends into the body towards a second side portion of the body that is opposite the first side portion. The transverse hole is sized to receive therein a knob of the baseball bat. The bat handle weight is further provided with a handle slot formed in the body from the first side portion to the second side portion and through a third side portion that is adjacent the first and second side portions, wherein the handle slot extends to the transverse hole and across a bottom of the transverse hole at the second side portion, and wherein the handle slot and the transverse hole form a shoulder portion at a bottom of the transverse hole adjacent the second side portion, and wherein the handle slot has a width that that is greater than a diameter of a handle of the baseball bat and less than a diameter of the knob. The method further includes inserting a knob of a baseball bat handle into the knob insertion opening, and rotating the body of the bat handle weight such that the knob remains in the transverse hole as the baseball bat handle traverses the handle slot from the first side portion to the second side portion, wherein the knob bears against the shoulder portion.

In accordance with another feature, providing the bat handle weight further comprises providing the bat handle weight to have a vinyl cover formed over the body.

In accordance with another feature, providing the bat handle weight having a body comprises providing the bat handle weight having a cylindrical body, wherein the transverse hole is formed in the cylindrical body perpendicular to an axis of the cylindrical body.

Although the invention is illustrated and described herein as embodied in a bat handle weight, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

Figure 1:
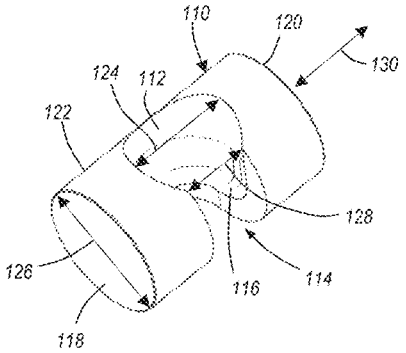
FIG. 1 is a perspective view of an bat handle weight showing the knob insertion opening, in accordance with some embodiments.

Those skilled in the field of the present disclosure will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. The details of well-known elements, structure, or processes that would be necessary to practice the embodiments, and that would be well known to those of skill in the art, are not necessarily shown and should be assumed to be present unless otherwise indicated.

DETAILED DESCRIPTION

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Figure 2:
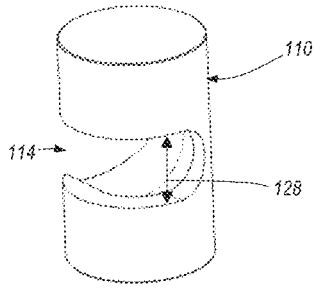
FIG. 2 is a perspective view of the bat handle weight showing the handle slot, with the bat handle weight rotated from the position of FIG. 1, in accordance with some embodiments.
Figure 3:
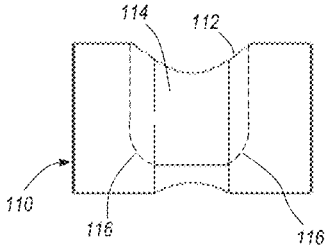
FIG. 3 is a side view of the bat handle weight oriented to have the knob insertion opening upward, and looking into the handle slot, in accordance with some embodiments.
Figure 4:
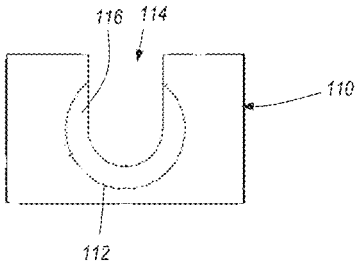
FIG. 4 shows a side view of the bat handle weight looking into the knob insertion opening and with the handle slot oriented upward, in accordance with some embodiments.
Figure 5:
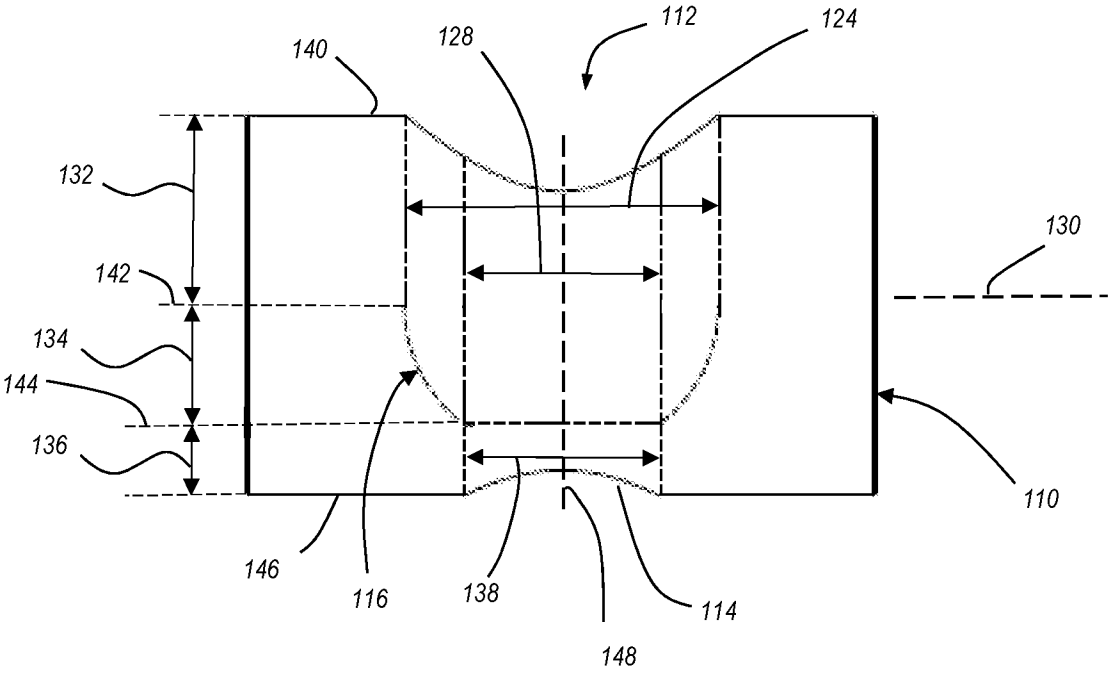
FIG. 5 shows a side view of the bat handle weight opposite the view of FIG. 3, showing the handle slot and knob insertion opening in broken line, in accordance with some embodiments.

FIGS. 1-5 shows a series of views of an bat handle weight, in accordance with some embodiments. The views of the bat handle weight 110 are as follows:

FIG. 1 is a perspective view of an bat handle weight 110 showing the knob insertion opening 112 and a portion of the handle slot 114. FIG. 2 is a perspective view of the bat handle weight 110 showing the handle slot 114, with the bat handle weight 110 rotated from the position of FIG. 1. FIG. 3 is a side view of the bat handle weight 110 oriented to have the knob insertion opening 112 oriented upward, and looking into the handle slot 114. FIG. 4 shows a side view of the bat handle weight 110 looking into the knob insertion opening 112 and with the handle slot 114 oriented upward. FIG. 5 shows a side view of the bat handle weight 110 opposite the view of FIG. 3, showing the handle slot 114 and knob insertion opening 112 in broken line.

In FIGS. 1-5 the bat handle weight 110 is shown having a generally cylindrical body having two opposing circular ends 118, 120 and a side 122 between the ends 118, 120. A knob insertion opening 112 is formed as a transverse hole in the side 122 that has a diameter 124 that is less than a diameter 126 of the body. The knob insertion opening 112 is formed at the opening of a circular, transverse hole that extends from a side of the body of the bat handle weight 100 partway through the body towards a side portion of the body that is opposite the knob insertion opening 112. The knob insertion opening 112 is configured to be slightly larger than a typical diameter of the knob of a standard baseball bat. The knob is at the end of the handle of the bat and is larger in diameter than the handle to keep the bat from sliding out of the batter's hands when the batter swings the bat. The bat handle weight 110 further includes a handle slot 114 formed in the side 122 of the body from the knob insertion opening 112 around the body to a point opposite the start of the knob insertion opening 112. The handle slot 114 extends away from the knob insertion opening 112 such that a centerline of the handle slot, in a direction wrapping around the side of the body along the slot, would pass through the center of the knob insertion opening 112 at the side of the body where the opening for the knob insertion opening is formed. The width 128 of the handle slot 114 is less than the diameter of the knob insertion opening 112, but slightly wider than the diameter/width of the handle of a typical baseball bat. The particular dimensions of the diameter 124 of the knob insertion opening 112, body diameter 126, and slot width 128 of the handle slot 114 can vary for particular classes of bats, such as, for example, full size/professional bats, little league bats, and so on.

As can be seen in FIG. 5, the transverse hole (shown in broken line) forming the knob insertion opening 112, which passes partway through the body of the bat handle weight 100 along axis 148 in a direction that is perpendicular to an axis 130 of the body of the bat handle weight 100. The transverse hole, from the first side 140 to the second side 146 of the body is centered along axis 148, as is the handle slot 114. The transverse hole extends for a first distance 132 from the first side 140 to approximately the middle 142 of the body. The first diameter 124 of the transverse hole is the same as at the first side 140. The diameter of the transverse hole decreases for a second distance 134 along an inward tapered portion 116 to the second diameter 138 which is equal to the slot width 128 of the handle slot 114, forming a shoulder against which the knob of the bat handle will bear upon coupling the bat handle weight 100 to the bat handle. The transverse hole extends from the bottom 144 of the shoulder to the second side 146 for a third distance 136 at the second diameter 138.

The handle slot 114, as shown here, extends around the side 122 of the body of the bat handle weight 100 to a location on the side of the body 122 opposite, and centered, with respect to where the transverse opening begins on the side 122 of the body, which is essentially halfway around the body of the bat handle weight 100. In some embodiments it is contemplated that the handle slot can end at a different location on the side 122, relative to where the transverse opening begins on the side 122. For example, the handle slot 114 can extend less or further than halfway around the body of the bat handle weight 100. In some embodiments the handle slot can extend traverse approximately one quarter of the way around the body of the bat handle weight 100. In such cases, the shoulder to accommodate the knob of the bat handle will be formed in the appropriate location and orientation in the knob insertion opening 112.

Figure 14:
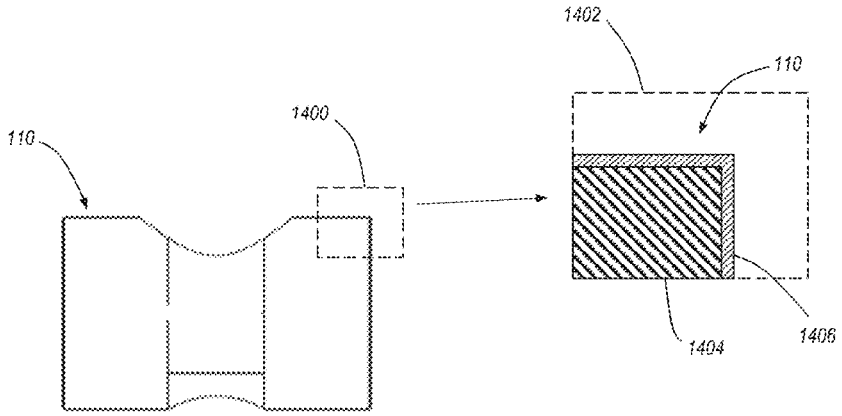
FIG. 14 shows a detail of a cross section of a portion of a bat handle weight, in accordance with some embodiments.

The body of the bat handle weight 100 can be made of a rigid, solid material such as aluminum or steel, to have a desired weight. Furthermore, the body of the bat handle weight 100 can be covered with a layer of vinyl or a similarly resilient material that will have a higher coefficient of friction against the material of the bat than the metal or other weighty material used to form the body of the bat handle weight 100. FIG. 14 shows a side view of a bat handle weight 110 as in FIG. 3, where a detail section 1400 is enlarged and cross sectioned in detail 1402. The body 1404 of the bat handle weight 110 can be made of aluminum, steel, or any other rigid form. The body 1404 in some embodiments can be hollow is filled with sand, water, or some other such substance. A covering 1406 is formed over the body 1404 that can be rubber, vinyl, polyvinyl, or a similar polymeric material that has a higher coefficient of friction than the material of the body 1404, and which is resilient so as to absorb/cushion impacts. Thus, a variety of bat handle weights can be made having different weights for user preference, and different dimensions for fitting on different classes of bats.

Figure 6:
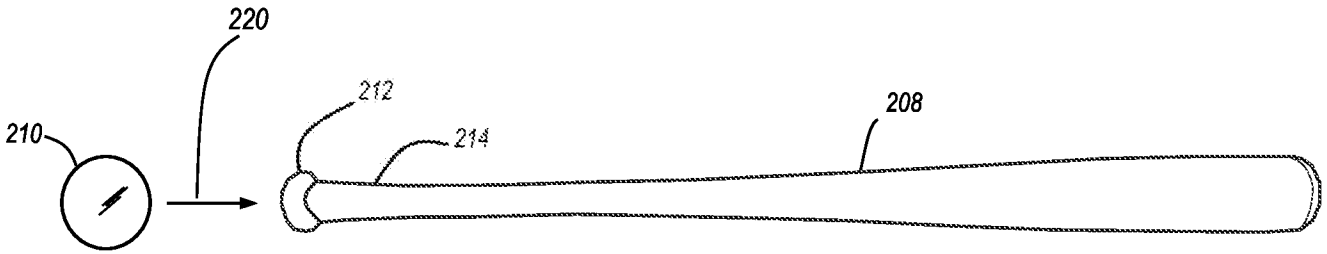
FIG. 6 shows a series diagram for coupling a bat handle weight to a bat with the bat handle weight not yet on the bat handle end, wherein the bat handle weight is seen from an end view, in accordance with some embodiments.
Figure 7:
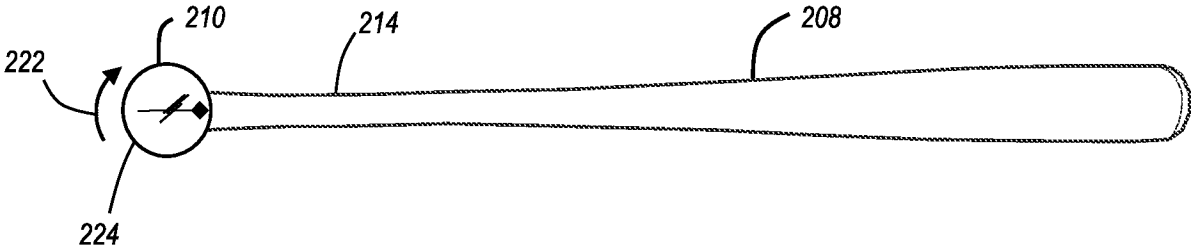
FIG. 7 shows a series diagram for coupling a bat handle weight to a bat with the bat handle knob initially inserted into the knob insertion opening of the bat handle weight, wherein the bat handle weight is seen from an end view, in accordance with some embodiments.
Figure 8:
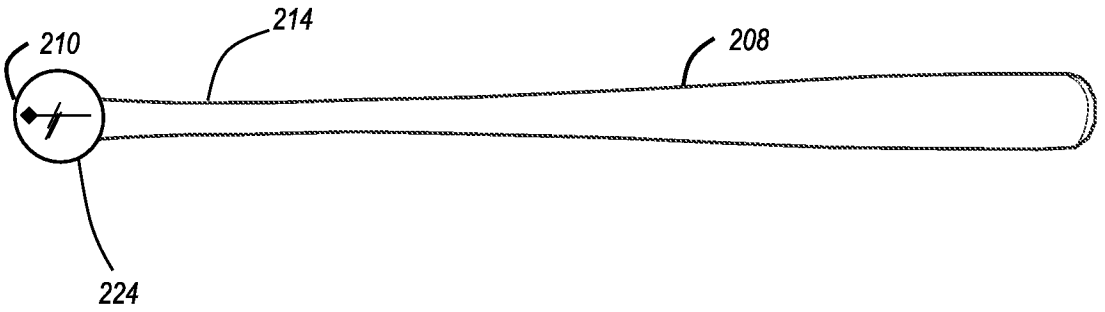
FIG. 8 shows a series diagram for coupling a bat handle weight to a bat with the bat handle knob inserted into the knob insertion opening and the bat handle weight rotated from that of FIG. 7 to capture the bat handle weight on the handle end of the bat, wherein the bat handle weight is seen from an end view, in accordance with some embodiments.
Figure 9:
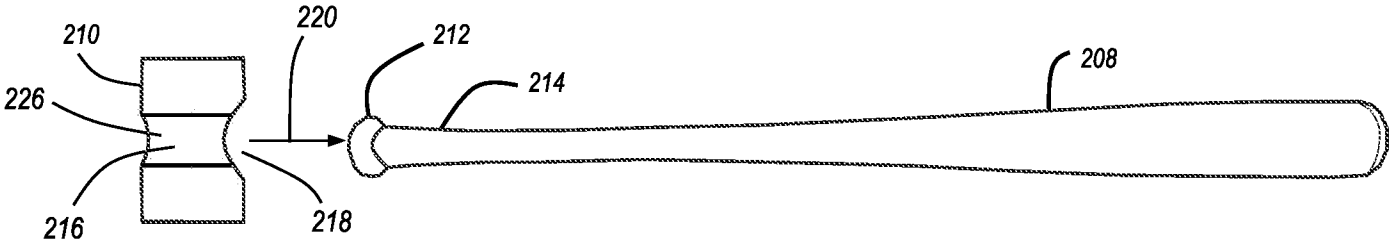
FIG. 9 shows a series diagram for coupling a bat handle weight to a bat with the bat handle weight not yet on the bat handle end, wherein the bat handle weight is seen from a side view, in accordance with some embodiments.
Figure 10:
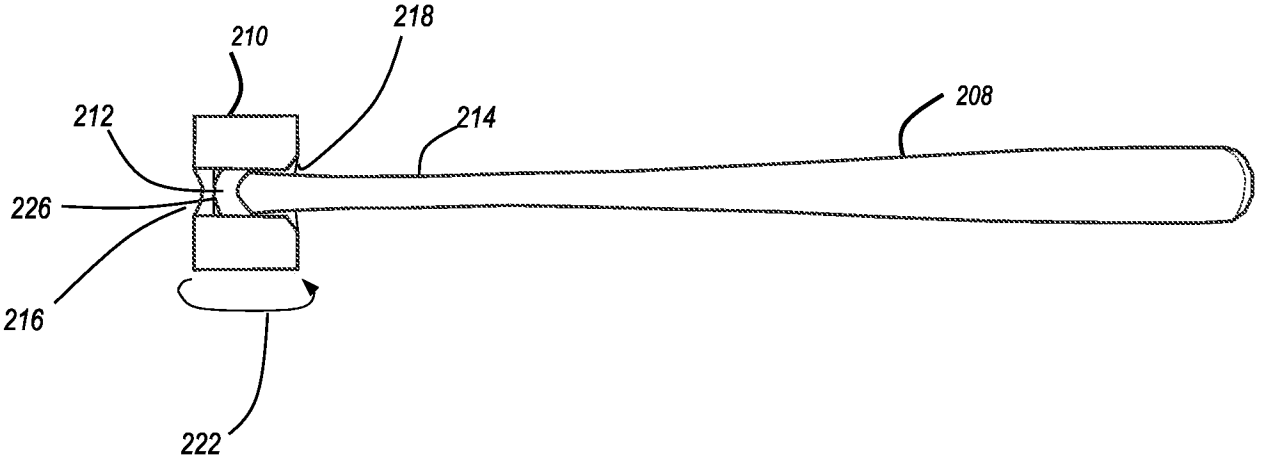
FIG. 10 shows a series diagram for coupling a bat handle weight to a bat with the bat handle knob initially inserted into the knob insertion opening of the bat handle weight, wherein the bat handle weight is seen from a side view, in accordance with some embodiments.
Figure 11:
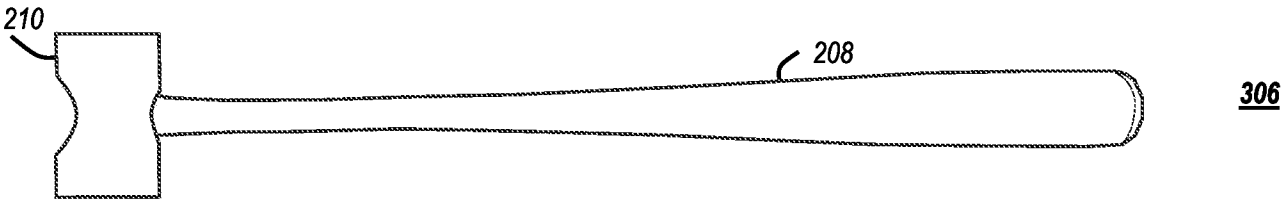
FIG. 11 shows a series diagram for coupling a bat handle weight to a bat with the bat handle knob inserted into the knob insertion opening and the bat handle weight rotated from that of FIG. 10 to capture the bat handle weight on the handle end of the bat, wherein the bat handle weight is seen from a side view, in accordance with some embodiments.

FIGS. 6-11 show a series of illustrations that show the coupling of a bat handle weight to a bat handle. In particular FIGS. 6-8 show the bat handle weight 210 from an end view during the coupling process, and FIGS. 9-11 show the bat handle weight 210 from a side view on the side of the bat handle weight 210 having the handle slot 216. In FIGS. 6 and 9, the bat handle weight 210 is shown separate and uncoupled from the bat 208. The bat includes a handle 214 that is terminated at a knob 212. The knob 212 has a larger diameter than the handle 214 and helps to prevent the bat 208 from coming out of the batter's hands when swinging the bat 208. To couple the bat handle weight 210 to the bat handle 214, the bat handle weight 210 is first oriented so that the knob insertion opening 218 is facing the knob 212. Then the bat end weight 210 is moved in the direction of arrow 220, or the bat 208 is moved in the opposite direction of arrow 220, or both are moved together along the direction of arrow 220.

In FIGS. 7 and 10, the bat end weight 210 is initially placed on the bat handle such that the knob 212 is within the knob insertion opening 218. In FIGS. 7-8 an indicator 224 is show to indicate the relative orientation of the bat handle weight 210 as once the bat handle weight 210 is positioned over the knob 212 and the knob 212 is within the knob insertion opening 218, the bat handle weight 210 is then rotated as indicated by arrow 222 such that the handle slot passes over the handle 214, thereby capturing the knob 212 in the knob insertion opening 218 where the know 212 will bear against the inward tapering portion 226 of the knob insertion opening 218 where the diameter of the knob insertion opening 218 decreases to the width of the handle slot 216.

In FIGS. 8 and 11 the bat handle weight 210 is captured on the handle 214 of the bat 208 by interference between the shoulder in the knob insertion opening 218 created by the width of the handle slot 216 being less than the diameter of the knob 212, but slightly more than the diameter of the handle 214. In FIG. 8 the indicator 224 is pointing the opposite direction from that in FIG. 7, indicating the bat handle weight has been rotated approximately one hundred eighty degrees to capture the knob 212 in the bat handle weight 210. As shown in FIGS. 8 and 11, the bat 208 can be swung by a batter with the bat handle weight 210 on the bat 208.

Those skilled in the art will appreciate that the features of the bat handle weight as described can be varied while achieving equivalent form and function. For example, the bat handle weight has been described as having a cylindrical body, but other shapes can be used to achieve an equivalent bat weight effect. A cylindrical body, however, allows the user to stand the bat handle weight on one of the flat ends, which prevents the bat handle weight from rolling, while also presenting a rounded exterior surface towards the batter's hands.

Figure 12A:
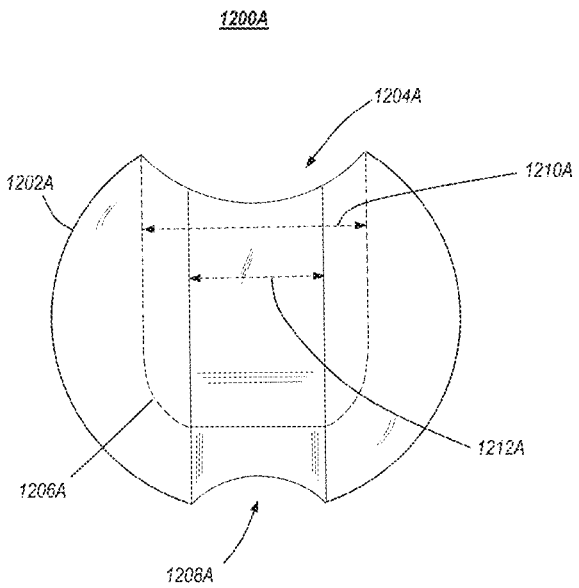
FIG. 12A shows a side view of a spherical bat handle weight, in accordance with some embodiments.
Figure 12B:
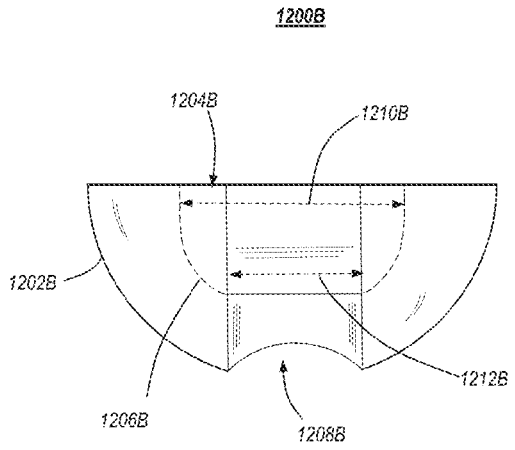
FIG. 12B show a side view of a semi-spherical bat handle weight, in accordance with some embodiments.
Figure 13:
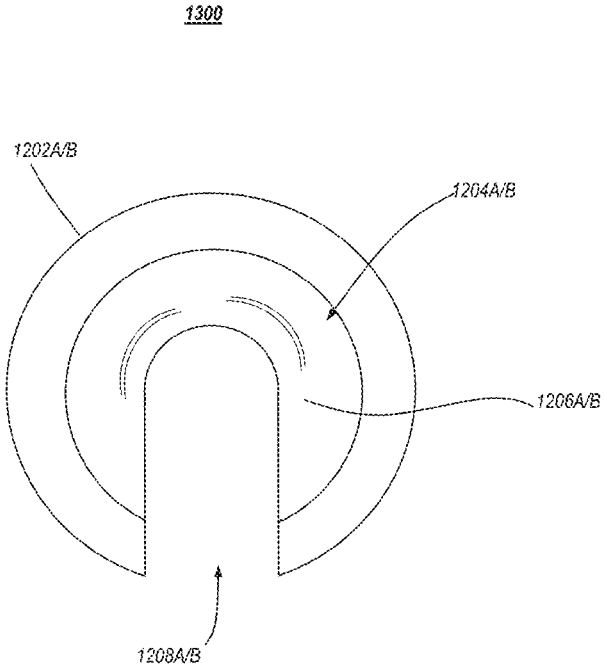
FIG. 13 shows a top view of a spherical or semi-spherical bat handle weight, in accordance with some embodiments.

FIGS. 12A, 12B, and 13 show a side view of bat handle weight 1200A having a spherical body, a side view of a bat handle weight 1200B having a semispherical body, and a top view 1300 looking into the knob insertion opening 1204A/B of either the spherical or semi-spherical bat handle weights, 1200A, 1200B. A knob insertion opening 1204A/B is formed from one side of the body of the bat handle weight 1202A/B into the body of the bat handle weight 1202A/B, but not completely through the body of the bat handle weight 1202A/B. In some embodiments the knob insertion opening 1204A/B can reduce in diameter to form an inwardly sloped portion 1206A/B, and in some embodiments the transverse hole forming the knob insertion opening can simply stop, leaving a vertical to horizontal transition at ninety degrees to form a similar shoulder that can bear against the knob of the bat. A handle slot 1208A/B is formed centered on one side of the knob insertion opening 1204A/B, extending from the inner wall defining the transverse opening outward through the sides of the body of the bat handle weight 1202A/B. The knob insertion opening 1204A/B is sized 1210A/B to accept the knob of a bat handle, which has a larger diameter than the bat handle. The handle slot 1208A/B is sized 1212A/B to be narrower that the diameter of the knob, but slightly wider than the bat handle. When coupled onto the bat handle the shoulder (e.g. 1206A/B) formed at the bottom (in these views) of the transverse hole forming the knob insertion opening 1204A/B will bear against the knob, thereby retaining the bat handle weight 1202A/B on the bat as the batter swings the bat.

Figure 15:
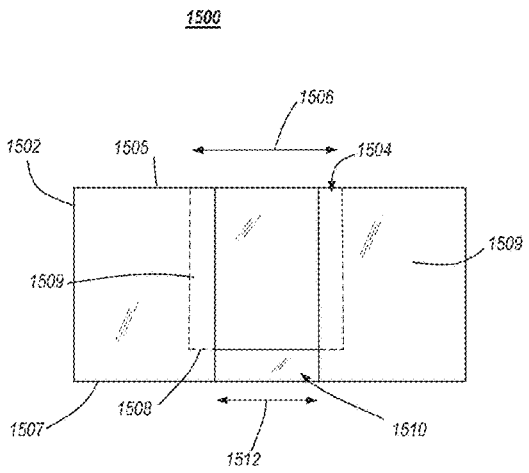
FIG. 15 shows a side view of a bat handle weight having a rectangular body, in accordance with some embodiments.
Figure 16:
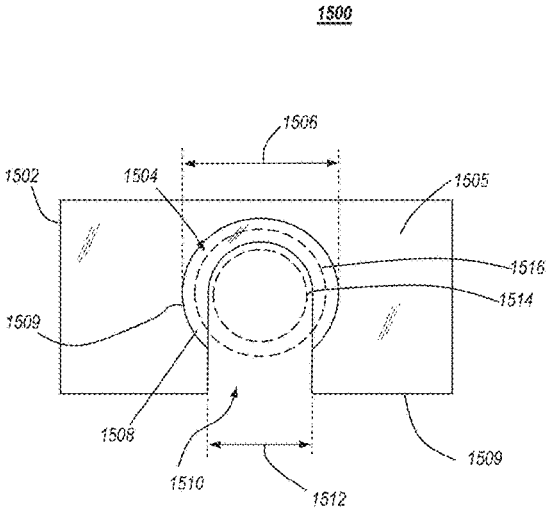
FIG. 16 shows a top view of a bat handle weight having a rectangular body, in accordance with some embodiments.

FIGS. 15-16 show another embodiment of a bat handle weight 1500 using a rectangular/rectanguloid body 1502. A transverse hole 1504 is formed at a top 1505 and extends into the body 1502 towards the opposite side/bottom 1507, but does not go completely through the body 1502. The transverse hole 1504 provides a knob insertion opening and has a diameter 1506 that is slightly larger than the diameter of a knob at the handle end of the baseball bat. It will be appreciated by those skilled in the art that, although the transverse hole 1504 shown here is circular, as is the case elsewhere in the drawings, a square hole or holes of other shapes can be used equivalently. The transverse hole 1504 must simply be dimensioned such that the knob of a bat can fit into the transverse hole 1504. Likewise, where the transverse hole ends, it can end abruptly, as here, forming a shoulder 1508 at a ninety-degree angle to the inner wall 1509 defining the transverse hole 1504, or it can reduce in diameter after a certain distance, as indicated in FIG. 5. A handle slot 1510 is formed at an adjacent side 1507 through the body, form the top 1503 to the bottom 1507 and to the transverse hole 1504. Across the bottom 1507 the handle slot continues to the center of the transverse hole 1504 such that, upon being coupled onto the handle of a bat, the handle will be substantially centered in the body 1502, as indicated by dashed circle 1514, which represent a cross section of a baseball bat handle in the handle slot 1510 when the bat handle weight is coupled to a baseball bat handle. The knob of the bat handle is represented by dashed line 1516, which bears against shoulder 1508 to retain the bat handle weight on the bat handle.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description as part of the original disclosure, and remain so even if cancelled from the claims during prosecution of the application, with each claim standing on its own as a separately claimed subject matter. Furthermore, subject matter not shown should not be assumed to be necessarily present, and that in some instances it may become necessary to define the claims by use of negative limitations, which are supported herein by merely not showing the subject matter disclaimed in such negative limitations A bat handle weight has been disclosed that greatly reduces, if not eliminates, the negative consequences of casting cause by swinging a bat having a ring weight on the barrel of the bat. The inventive bat handle weight fits on, and is retained by the knob of the bat handle. The conventional paradigm of baseball bat weights is that the weight has to have a hole that is larger than the knob of the bat, thus, it is impossible for the knob to retain the bat weight. However the bat weight disclosed herein solved this problem by using a transverse hole sized to receive the knob therein, but which does not pass entirely through the body of the bat handle weight. To retain the bat handle weight on the knob, a handle slot is formed in the body of the inventive bat handle weigh that allow the bat handle weight to be rotated by passing over the handle of the bat, thereby resulting in the knob, and specifically the portion of the knob adjacent the end of the handle, where the knob and handle meet, bearing against the bat handle weight in the transverse hole, at the bottom of the transverse hole.

What is claimed is:

1. A baseball bat handle weight for attaching to a handle end of a baseball bat, the handle end having a knob having a larger diameter than a diameter of the handle of the baseball bat, the baseball bat handle weight comprising:

a body having an axis, wherein the body is cylindrical in a direction along the axis, wherein the body has a first end that is flat and defines a plane perpendicular to the axis of the body, and the body has a second end that is flat and defines a plane perpendicular to the axis of the body;

a transverse hole formed through the body, perpendicular to the axis, that is bounded by an inner wall in the body that extends from a first side of the body to a second side of the body that is opposite the first side on the body, the transverse hole forming a knob insertion opening at the first side of the body, the knob insertion opening having a first diameter at the first side of the body, the transverse hole being defined by the inner wall which extends into the body perpendicular to the axis of the body a first distance from the first side at the first diameter along the first distance to approximately a middle of the body between the first side of the body and the second side of the body, the inner wall of the transverse hole having an inward tapered portion after the first distance in the transverse hole along a second distance in a direction toward the second side from the first side, wherein the inner wall of transverse hole narrows to a second diameter at a bottom of the inward tapered portion, wherein the second diameter is smaller than the first diameter, and wherein the bottom of the inward tapered portion forms a shoulder in the transverse hole that is closer to the second side of the body than to the first side of the body, and wherein the inner wall continues a third distance from the bottom of the inward tapered portion to the second side of the body at the second diameter; and a handle slot formed in the body that extends into the body to the transverse hole the handle slot extends on a front side, and from the first side at the knob insertion opening to the second side of the body, and aligned with the transverse hole, and having a width in a direction parallel to the axis of the body that is equal to the second diameter along the entirety of the handle slot from the first side to the second side.

2. The baseball bat handle weight of claim 1, further comprising a covering over the body.

3. The baseball bat handle weight of claim 2, wherein the covering is comprised of vinyl.

4. The baseball bat handle weight of claim 1, wherein the body is metal.

5. A baseball bat handle weight system, comprising:

a baseball bat, the baseball bat having a knob formed at an end of the handle, the knob having a knob diameter, wherein the knob diameter is larger than a diameter of the handle;

a body having an axis, wherein the body is cylindrical in a direction along the axis, wherein the body has a first end that is flat and defines a plane perpendicular to the axis of the body, and the body has a second end that is flat and defines a plane perpendicular to the axis of the body;

a transverse hole formed through the body that is bounded by an inner wall in the body, the transverse hole forms a knob insertion opening having a first diameter at a first side of the body, the inner wall extends from the first side of the body to a second side of the body that is opposite the first side, wherein the transverse hole extends into the body in a direction perpendicular to the axis of the body, from the first side a first distance to approximately a middle of the body, between the first side and the second side, at the first diameter along the first distance, and narrows to a second diameter that is smaller than the first diameter to form a shoulder in the transverse hole that is closer to the second side of the body that to the first side, the transverse hole further extends from the shoulder to the second side of the body at the second diameter, wherein the first diameter of the transverse hole is greater than the knob diameter, and the second diameter is smaller than the knob diameter and greater than the diameter of the handle of the baseball bat; and a handle slot formed through the body to the transverse hole, the handle slot aligned with the transverse hole, and which extends on a front side from the first side of the body to the second side of the body, and wherein the handle slot has a width that is equal to the second diameter along the handle slot, and along an entirety of the handle slot from the first side of the body to the second side of the body;

wherein the knob of the bat bears against the shoulder, and the handle of the bat extends out of the body from the transverse hole at the second side of the body.

6. The baseball bat handle weight system of claim 5, further comprising a covering over the body that has a coefficient of friction that is higher than a material of the body.

7. The baseball bat handle weight system of claim 6, wherein the covering is comprised of vinyl.

8. The baseball bat handle weight system of claim 5, wherein the body is metal.

9. A method for coupling a baseball bat handle weight to a baseball bat, the method comprising;

providing a baseball bat having a handle and a knob at an end of the handle, a diameter of the knob being larger than a diameter of the handle;

providing the baseball bat handle weight having:

a body having an axis;

a transverse hole formed through the body, perpendicular to the axis of the body, that is bounded by an inner wall in the body that extends from a first side of the body to a second side of the body that is opposite the first side on the body, the transverse hole having a first diameter from the first side of the body into the body a first distance to approximately a middle of the body between the first side and the second side at the first diameter along the first distance the inner wall of the transverse hole having an inward tapered portion, wherein the inner wall of transverse hole narrows to a second diameter that is smaller than the first diameter beyond the first distance to form a shoulder that is closer to the second side of the body than to the first side of the body, wherein the transverse hole extends from the shoulder to the second side of the body at the second diameter, wherein the first diameter of the transverse hole is greater than the diameter of the knob of the baseball bat, and the second diameter is smaller than the knob of the baseball bat and greater than the diameter of the handle of the baseball bat;

a handle slot formed into the body to the transverse hole and which extends on a front side from the first side of the body to the second side of the body along the transverse hole and aligned with the transverse hole, and wherein the handle slot has a width along its entirety from the first side to the second side that that is equal to the second diameter;

inserting the knob of the baseball bat handle into the transverse hole at the first side of the body; and after inserting the knob into the transverse hole, rotating the body of the bat handle weight one hundred eighty degrees so that the knob of the bat comes into contact with the shoulder in the transverse hole so that the knob bears against the shoulder in the transverse hole and the handle extends out of the body at the second side of the body.

10. The method of claim 9, wherein providing the baseball bat handle weight further comprises providing the bat handle weight to have a vinyl cover formed over the body.

11. The method of claim 9, wherein providing body of the baseball bat handle weight comprises providing the baseball bat handle weight having a cylindrical body in a direction along the axis of the body, wherein the body has a first end that is flat and defines a plane perpendicular to the axis, and the body has a second end that is flat and defines a plane perpendicular to the axis of the body.

* * * * *